US011221122B2

(12) United States Patent
Miyairi

(10) Patent No.: US 11,221,122 B2
(45) Date of Patent: Jan. 11, 2022

(54) LIGHTING DEVICE AND HEADLIGHT HAVING A REFLECTOR, LENSES AND LIGHT-SHIELDING MEMBERS

(71) Applicant: NICHIA CORPORATION, Anan (JP)

(72) Inventor: Hiroshi Miyairi, Yokohama (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 17/184,262

(22) Filed: Feb. 24, 2021

(65) Prior Publication Data

US 2021/0301998 A1 Sep. 30, 2021

(30) Foreign Application Priority Data

Mar. 27, 2020 (JP) ..... JP2020-058029
Sep. 3, 2020 (JP) ..... JP2020-148415

(51) Int. Cl.
*F21S 41/692* (2018.01)
*F21S 41/32* (2018.01)
*F21S 41/265* (2018.01)
*F21S 41/148* (2018.01)
(Continued)

(52) U.S. Cl.
CPC ..... *F21S 41/692* (2018.01); *F21S 41/148* (2018.01); *F21S 41/265* (2018.01); *F21S 41/321* (2018.01); *F21S 41/47* (2018.01); *F21W 2102/135* (2018.01)

(58) Field of Classification Search
CPC ..... F21S 41/68; F21S 41/683; F21S 41/686; F21S 41/689; F21S 41/692; F21S 41/695; F21S 41/698; F21W 2102/00; F21W 2102/10; F21W 2102/13; F21W 2102/135; F21W 2102/14; F21W 2102/145; F21W 2102/15; F21W 2102/155; F21W 2102/16; F21W 2102/165; F21W 2102/17; F21W 2102/18; F21W 2102/19; F21W 2102/20; F21W 2102/30; F21W 2102/40
See application file for complete search history.

(56) References Cited

U.S. PATENT DOCUMENTS

2013/0010488 A1 1/2013 Koizumi
2016/0123551 A1 5/2016 Shin
(Continued)

FOREIGN PATENT DOCUMENTS

CN 207778305 U 8/2018
DE 10 2015 221 604 A1 5/2016
JP 2006-147196 A 6/2006
(Continued)

*Primary Examiner* — Robert J May
(74) *Attorney, Agent, or Firm* — Foley & Lardner LLP

(57) ABSTRACT

A lighting device includes: a light emission part; a reflector disposed above the light emission part and configured to reflect a first portion of light emitted from the light emission part; a first lens having a first incident face through which light reflected by the reflector enters; a second lens disposed higher than the first lens, and having a second incident face through which a second portion of the light emitted from the light emission part enters, wherein the second incident face is father than the first incident face from the light emission part; a first light shielding member disposed between the first lens and the second lens; a second light shielding member between the light emission part and the first lens; a third light shielding member between the light emission part and the second lens; and an actuator configured to move the second and third light shielding members.

8 Claims, 13 Drawing Sheets

(51) Int. Cl.
*F21S 41/47* (2018.01)
*F21W 102/135* (2018.01)

(56) References Cited

U.S. PATENT DOCUMENTS

| | | | |
|---|---|---|---|
| 2017/0158113 | A1 | 6/2017 | Kanayama et al. |
| 2020/0003384 | A1 | 1/2020 | Rice |

FOREIGN PATENT DOCUMENTS

| | | | |
|---|---|---|---|
| JP | 2007-053053 | A | 3/2007 |
| JP | 2013-016400 | A | 1/2013 |
| JP | 2016-054103 | A | 4/2016 |
| JP | 2017-103189 | A | 6/2017 |

LIGHTING DEVICE AND HEADLIGHT HAVING A REFLECTOR, LENSES AND LIGHT-SHIELDING MEMBERS

CROSS-REFERENCE TO RELATED APPLICATIONS

This application claims priority to Japanese Patent Application No. 2020-058029, filed on Mar. 27, 2020, and Japanese Patent Application No. 2020-148415, filed on Sep. 3, 2020, the disclosures of which are hereby incorporated by reference in their entireties.

BACKGROUND

The present disclosure relate to lighting devices and headlights.

As a vehicular headlight of an automobile and the like, a lighting device capable of switching between low beam and high beam light distribution patterns has been known. For such a lighting device, there is a need to achieve both low beam and high beam light distribution patterns using a single light emission part. See, for example, Japanese Patent Publication No. 2017-103189.

SUMMARY

One object of certain embodiments of the present disclosure is to provide a lighting device and a headlight capable of achieving both low beam and high beam light distribution patterns using a single light emission part.

A lighting device according to one embodiment includes: a light emission part, a reflector, a first lens, a second lens, a first light shielding member, a second light shielding member, a third light shielding member, and an actuator. The reflector is disposed above the light emission part, and reflects a first portion of light emitted from the light emission part. The first lens has a first incident face from which light reflected by the reflector enters. The second lens is disposed higher than the first lens in an up-down direction, and has a second incident face from which a second portion of the light emitted from the light emission part enters. A distance between the light emission part and the second incident face in a horizontal direction is smaller than a distance between the light emission part and the first incident face in the horizontal direction. The first light shielding member is disposed between the first lens and the second lens in the up-down direction. The second light shielding member whose position in the horizontal direction is between a position of the light emission part and a position of the first lens. The third light shielding member whose position in the horizontal direction is between a position of the light emission part and a position of the second lens. The actuator is capable of switching between a light-shielded state and a non-light-shielded state by moving the second light shielding member and the third light shielding member. In the light-shielded state, the second light shielding member shields a portion of light advancing from the reflector towards the first incident face, and the third light shielding member shields the second portion of the light advancing from the light emission part towards the second incident face. In the non-light-shielded state, the second light shielding member does not shield the light advancing from the reflector towards the first incident face, and the third light shielding member does not shield the second portion of the light.

A lighting device according to another embodiment includes: a substrate having an upper face and a lower face, a light emission part disposed on the upper face of the substrate, a reflector, a first lens, a second lens, a first light shielding member, a second light shielding member, a third light shielding member, and an actuator. The reflector is disposed on the upper face of the substrate to cover the light emission part, and reflects a first portion of light emitted from the light emission part. The first lens has a first incident face form which the light reflected by the reflector enters, a first emission face from which light entering the first incident face exits, and an upper face located between the first incident face and the first emission face. The second lens has a second incident face from which a second portion of the light emitted from the light emission part enters, a second emission face from which the light entering the second incident face exits, and a lower face located between the second incident face and the second emission face. The second lens is disposed higher than the first lens in a direction from the lower face to the upper face of the substrate, and a distance from a center of the light emission part to the second incident face is smaller than a distance from the center of the light emission part to the first incident face. The first light shielding member is disposed between the upper face of the first lens and the lower face of the second lens. The second light shielding member whose position in the direction from the light emission part to the first lens is between a position of the light emission part and a position of the first lens. The third light shielding member whose position in the direction from the light emission part to the second lens is between a position of the light emission part and a position of the second lens. The actuator is capable of switching between a light-shielded state and a non-light-shielded state by moving the second light shielding member and the third light shielding member. In the light-shielded state, the second light shielding member shields a portion of light advancing from the reflector towards the first incident face, and the third light shielding member shields the second portion of the light advancing from the light emission part towards the second incident face. In the non-light-shielded state, the second light shielding member does not shield the light advancing from the reflector towards the first incident face, and the third light shielding member does not shield the second portion of the light.

According to other embodiments, headlights are provided that include the lighting devices described above.

According to certain embodiments, a lighting device and a headlight capable of achieving both low beam and high beam light distribution patterns using a single light emission part can be provided.

DETAILED DESCRIPTION

A lighting device according to one embodiment includes: a substrate having an upper face and a lower face, a light emission part disposed on the upper face of the substrate, a reflector, a first lens, a second lens, a first light shielding member, a second light shielding member, a third light shielding member, and an actuator. The reflector is disposed on the upper face of the substrate to cover the light emission part, and reflects a first portion of light emitted from the light emission part. The first lens has a first incident face form which the light reflected by the reflector enters, a first emission face from which light entering the first incident face exits, and an upper face located between the first incident face and the first emission face. The second lens has a second incident face from which a second portion of the light emitted from the light emission part enters, a second emission face from which the light entering the second incident face exits, and a lower face located between the second incident face and the second emission face. The second lens is disposed higher than the first lens in a direction from the lower face to the upper face of the substrate, and a distance from a center of the light emission part to the second incident face is smaller than a distance from the center of the light emission part to the first incident face. The first light shielding member is disposed between the upper face of the first lens and the lower face of the second lens. The second light shielding member whose position in the direction from the light emission part to the first lens is between a position of the light emission part and a position of the first lens. The third light shielding member whose position in the direction from the light emission part to the second lens is between a position of the light emission part and a position of the second lens. The actuator is capable of switching between a light-shielded state and a non-light-shielded state by moving the second light shielding member and the third light shielding member. In the light-shielded state, the second light shielding member shields a portion of light advancing from the reflector towards the first incident face, and the third light shielding member shields the second portion of the light advancing from the light emission part towards the second incident face. In the non-light-shielded state, the second light shielding member does not shield the light advancing from the reflector towards the first incident face, and the third light shielding member does not shield the second portion of the light.

An example of a lighting device according to the embodiment will be explained below with reference to the drawings.

Figure 1:
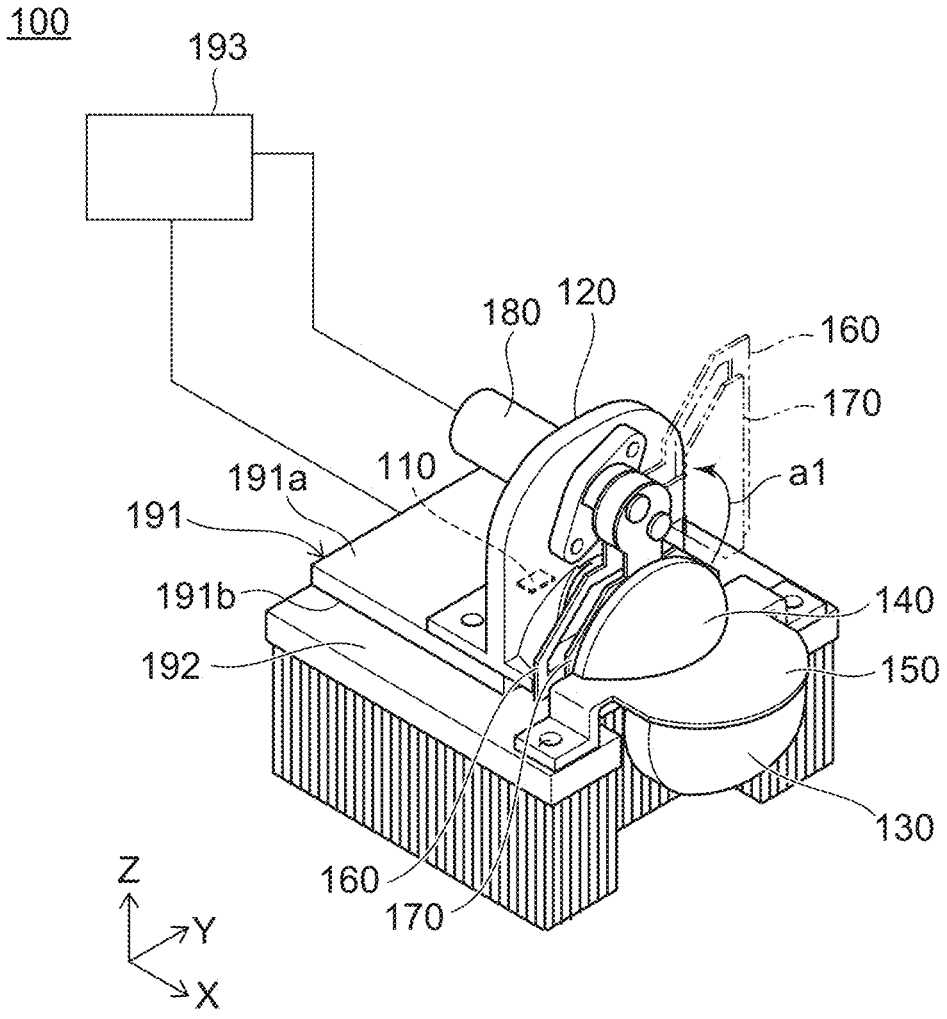
FIG. 1 is a perspective view of a lighting device according to an embodiment.

FIG. 1 is a perspective view of a lighting device according to an embodiment.

Figure 2:
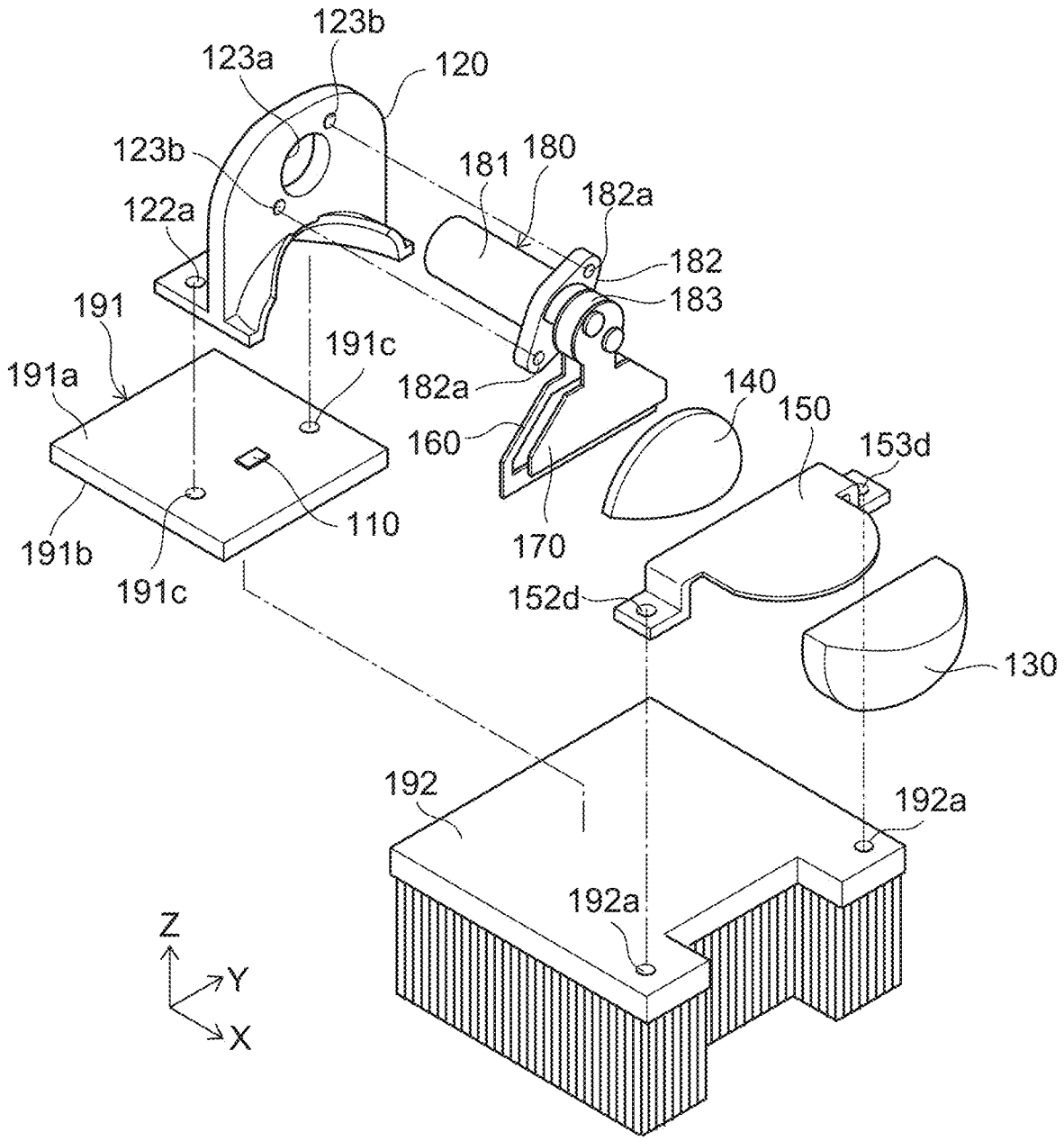
FIG. 2 is an exploded perspective view of the lighting device.

FIG. 2 is an exploded perspective view of the lighting device.

Figure 3:
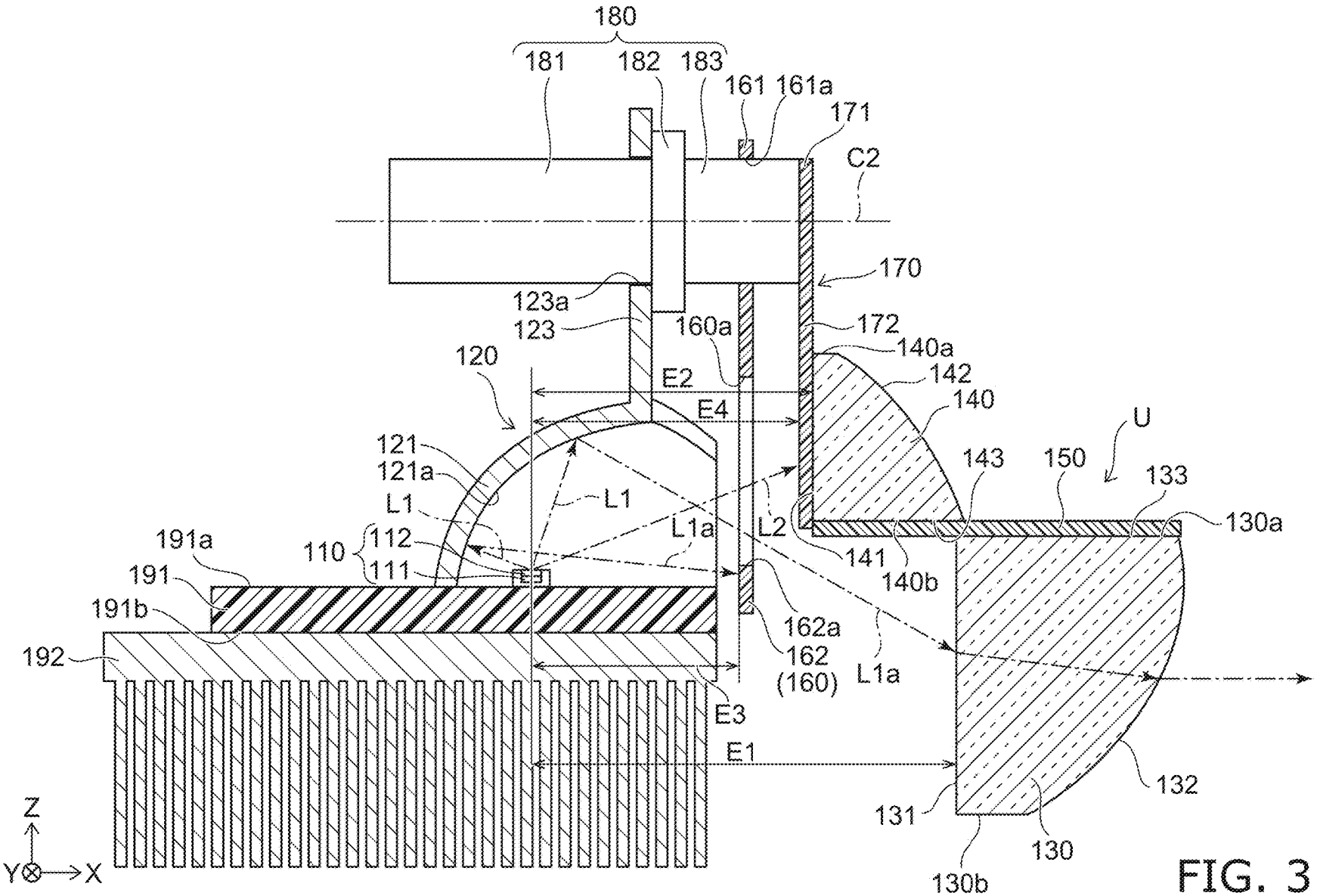
FIG. 3 is a partial cross-sectional view of the lighting device in a light-shielded state.

FIG. 3 is a partial cross-sectional view of the lighting device in a light-shielded state.

Figure 4:
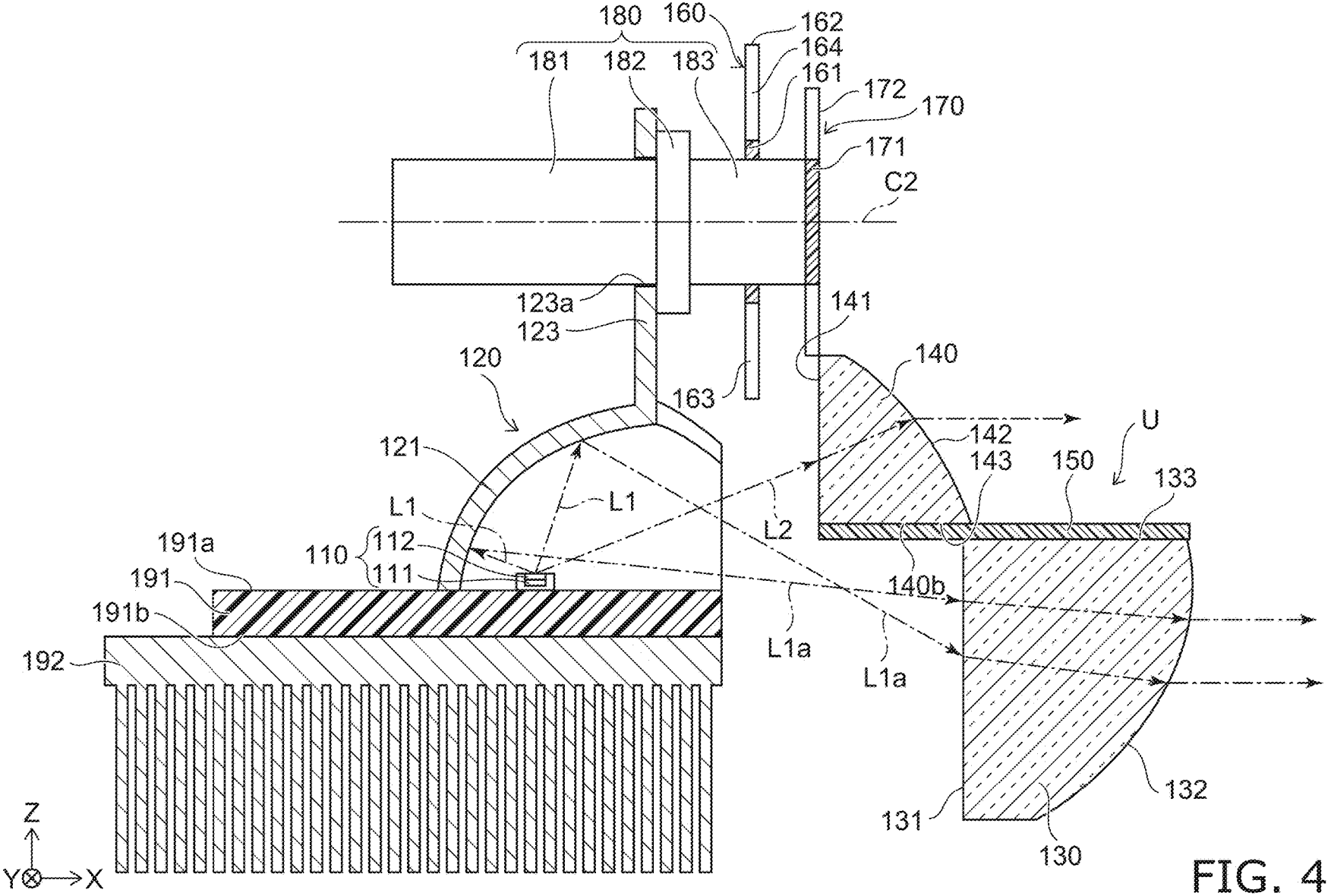
FIG. 4 is a partial cross-sectional view of the lighting device in a non-light-shielded state.

FIG. 4 is a partial cross-sectional view of the lighting device in a non-light-shielded state.

A lighting device 100 according to the embodiment can be used as a headlight of a vehicle such as an automobile. The lighting device 100 when installed in a vehicle can be switched between a low beam light distribution pattern and a high beam light distribution pattern.

In the explanation below, an XYZ orthogonal coordinate system will be used. For the purpose of making the explanation easier to understand, in the lighting device 100 installed in a vehicle, the direction from the lower side to the upper side of the vehicle will be referred to as the "up-down direction Z." A direction orthogonal to the up-down direction Z will be referred to as a "horizontal direction." With respect to horizontal directions when the lighting device 100 is installed in a vehicle, the direction from the rear to the front of the vehicle will be referred to as the "front-back direction X," and the direction from the right side to the left side of the vehicle will be referred to as the "left-right direction Y." However, terms indicating specific directions or positions (e.g., "up," "upward," "down," "downward," "right," "left," and others including these) merely indicate relative positions without being limited to the above description.

As shown in FIG. 1 and FIG. 2, the lighting device 100 according to the embodiment includes a light emission part 110, a reflector 120, a first lens 130, a second lens 140, a first light shielding member 150, a second light shielding member 160, a third light shielding member 170, and an actuator 180.

As shown in FIG. 3 and FIG. 4, the reflector 120 is disposed above the light emission part 110, and reflects a first portion L1 of the light emitted by the light emission part 110.

The first lens 130 has a first incident face 131 from which the light L1*a* reflected by the reflector 120 enters.

The second lens 140 is positioned higher than the first lens 130 in the up-down direction Z. The second lens 140 has a second incident face 141 from which a second portion L2 of the light emitted by the light emission part 110 enters. The distance E2 between the light emission part 110 and the second incident face 141 in the horizontal direction (the front-back direction X) is smaller than the distance E1 between the light emission part 110 and the first incident face 131 in the horizontal direction (the front-back direction X). Here, the distances E1 and E2 mean the distances from the center of the light emission part 110.

The first light shielding member 150 is disposed between the first lens 130 and the second lens 140 in the up-down direction Z. In the description herein, "light shielding" means that the transmittance of the irradiated light is less than 1%.

The position of the second light shielding member 160 in the horizontal direction (the front-back direction X) is between the position of the light emission part 110 and the position of the first lens 130. "The position of the second light shielding member 160 in the horizontal direction (the front-back direction X) is between the position of the light emission part 110 and the position of the first lens 130" merely specifies the relative positions of the second light shielding member 160, the light emission part 110, and the first lens 130 in the horizontal direction, but does not specify that the light emission part 110, the second light shielding member 160, and the first lens 130 are positioned on a straight line extending in the horizontal direction.

The position of the third light shielding member 170 in the horizontal direction (the front-back direction X) is between the position of the light emission part 110 and the position of the second lens 140. Similarly, "the position of the third light shielding member 170 in the horizontal direction (the front-back direction X) is between the position of the light emission part 110 and the position of the second lens 140" merely specifies the relative positions of the third light shielding member 170, the light emission part 110, and the second lens 140 in the horizontal direction, but does not specify that the light emission part 110, the third light shielding member 170, and the second lens 140 are positioned on a straight line extending in the horizontal direction.

The actuator 180 can switch between a light-shielded state and a non-light-shielded state by moving the second light shielding member 160 and the third light shielding member 170 as indicated by the arrow a1 in FIG. 1.

As shown in FIG. 3, in the light-shielded state, the second light shielding member 160 shields a portion of the light L1*a* advancing from the reflector 120 towards the first incident face 131, and the third light shielding member 170 shields the second portion L2 advancing from the light emission part 110 towards the second incident face 141. When the light emission part 110 is turned on in the light-shielded state, the lighting device 100 emits light having a low beam light distribution pattern.

As shown in FIG. 4, in the non-light-shielded state, the second light shielding member 160 does not shield the light L1*a* advancing from the reflector 120 towards the first incident face 131, and the third light shielding member 170 does not shield the second portion L2. When the light emission part 110 is turned on in the non-light shielded state, the lighting device 100 emits light having a high beam light distribution pattern.

In both the light-shielded and non-light-shielded states, the position of the second light shielding member 160 in the horizontal direction (the front-back direction X) is between the position of the light emission part 110 and the position of the first lens 130. Similarly, in both the light-shielded and non-light-shielded states, the position of the third light shielding member 170 in the horizontal direction (the front-back direction X) is between the position of the light emission part 110 and the position of the second lens 140. Each part of the lighting device 100 will be described in detail below.

The lighting device 100 includes a substrate 191.

The substrate 191, for example, is a wiring substrate in which wires to be connected to the light emission part 110 are provided in a base material such as a resin. The surfaces of the substrate 191 include an upper face 191*a* and a lower face 191*b* located opposite the upper face 191*a*.

The upper face 191*a* and the lower face 191*b* are flat faces parallel to the front-back direction X and the left-right direction Y. A light emission part 110 is mounted on the upper face 191*a*. Furthermore, a reflector 120 is attached to the upper face 191*a* so as to cover the light emission part 110.

A heatsink 192 is fastened to the lower face 191*b*. As shown in FIG. 2, the heatsink 192 is provided with through holes 192*a* passing through the heatsink 192 in the up-down direction Z. The substrate 191 is provided with through holes 191*c* passing through the substrate 191 in the up-down direction Z.

As shown in FIG. 3 and FIG. 4, the light emission part 110 in this embodiment includes a light emitting element 111 and a wavelength conversion member 112 that converts the wavelength of the light emitted from the light emitting element 111. The light emitting element 111, for example, is an LED (light emitting diode). In this embodiment, the color of the light emitted by the light emitting element 111 is blue. The wavelength conversion member 112 contains wavelength conversion particles such as phosphor particles. The color of the light emitted by the wavelength conversion member 112 is yellow. The color of the light emitted by the light emission part 110 is white resulting from mixing the blue light from the light emitting element 111 and the yellow light from the wavelength conversion member 112. The light emitting element 111 can emit green or red light, and the wavelength conversion member 112 can emit green or red light. The number of light emitting elements configuring the light emission part 110 can be one or more. Similarly, the number of wavelength conversion members provided in the light emission part 110 can be one or more.

Figure 5:
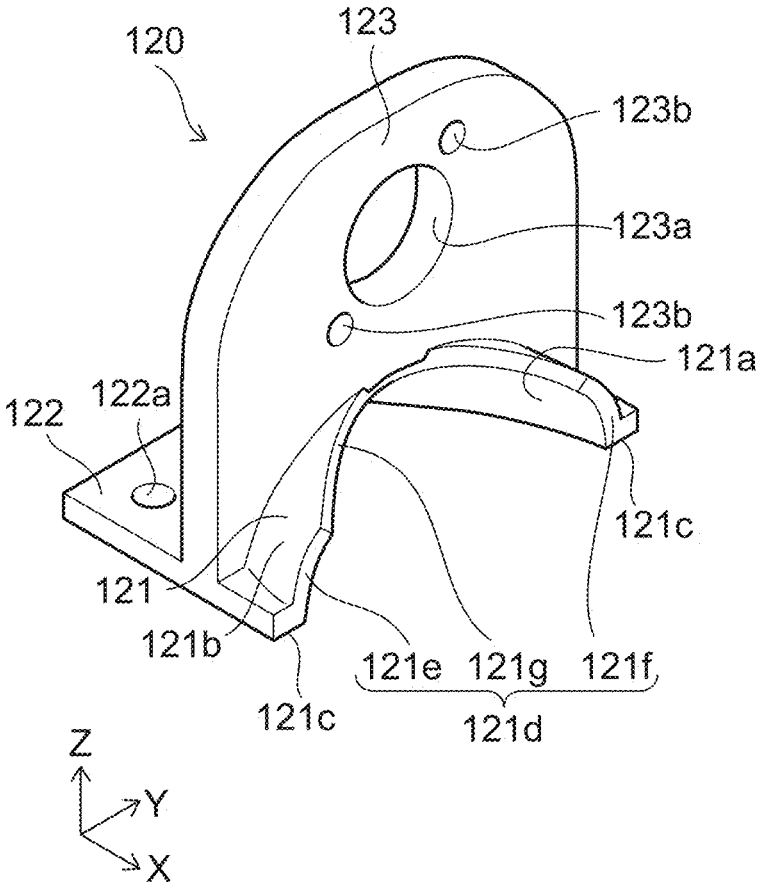
FIG. 5 is a perspective view of a reflector of the lighting device.

FIG. 5 is a perspective view of a reflector of the light emitting device.

Figure 6:
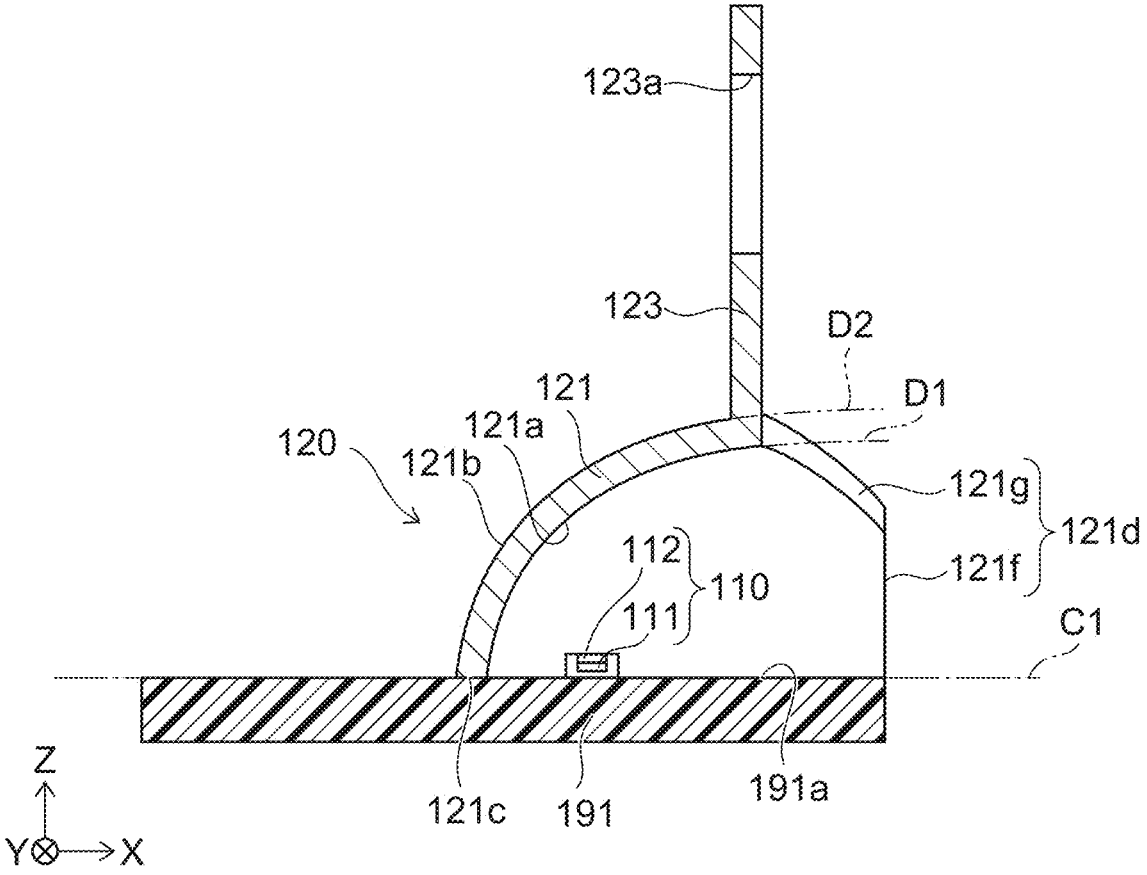
FIG. 6 is a cross-sectional view of a reflector and a substrate of the lighting device.

FIG. 6 is a cross-sectional view of the reflector and the substrate of the light emitting device.

As shown in FIG. 5, the reflector 120 in this embodiment includes a main body 121, a first attaching part 122, and a second attaching part 123. The reflector 120 is, for example, formed of a metal material such as aluminum.

The main body 121 in this embodiment is a concave mirror which is open in the front and bottom. The surfaces of the main body 121 include an inner face 121*a*, an outer face 121*b*, a lower face 121*c*, and a front face 121*d*.

As shown in FIG. 6, the inner face 121*a* substantially has a shape formed by rotating a curve D1, which becomes more distant towards the front from the central axis C1 extending in the front-back direction X, by 180 degrees about the central axis C1. The curve D1 is, for example, made by combining multiple parabolas. The inner face 121*a* faces the light emission part 110. The central axis C1 passes through the center of the light emission part 110 in a top view.

The outer face 121*b* is located opposite to the inner face 121*a*. The outer face 121*b* substantially has a shape formed by rotating a curve D2, which becomes more distant from the central axis C1 towards the front, by 180 degrees about the central axis C1.

The lower face 121*c* meets the lower edge of the inner face 121*a* and is provided in the periphery of the inner face 121*a*. The lower face 121*c* is in contact with the upper face 191*a* of the substrate 191.

The front face 121*d* is located between the front edge of the inner face 121*a* and the front edge of the outer face 121*b*. As shown in FIG. 5, the front face 121*d* has a first region 121*e* meeting the front edge of the lower face 121*c* on the right side, a second region 121*f* meeting the front edge of the lower face 121*c* on the left side, and a third region 121*g* located between the first region 121*e* and the second region 121*f*. The first region 121*e* and the second region 121*f* are substantially perpendicular to the upper face 191*a* of the substrate 191. The third region 121*g* is curved, recessed towards the back.

The first attaching part 122 is attached to the substrate 191. The first attaching part 122 protrudes rearwards from the main body 121 to be in contact with the upper face 191*a* of the substrate 191. The first attaching part 122 has a plate-like shape. The first attaching part 122 is provided with first through holes 122*a* passing through the first attaching part 122 in the up-down direction Z. As shown in FIG. 2, in the first through holes 122*a* and the through holes 191*c* of the substrate 191, fasteners such as screws or rivets for fastening the reflector 120 to the substrate 191 will be provided.

The actuator 180 is attached to the second attaching part 123. As shown in FIG. 5, the second attaching part 123 protrudes upwards from the main body 121. The second attaching part 123 is provided with a second through hole 123*a* passing through the second attaching part 123 in the front-back direction X. As shown in FIG. 3, the motor 181 of the actuator 180 is placed through the second through hole 123*a*. Furthermore, as shown in FIG. 5, the second attaching part 123 is provided with third through holes 123*b* passing through the second attaching part 123 in the front-back direction X. As shown in FIG. 2, in the third through holes 123*b* and the through holes 182*a* of the holder 182 of the actuator 180 explained later, fasteners such as screws or rivets for fastening the holder 182 to the reflector 120 will be provided.

The construction of the reflector 120 is not limited to what has been described above. For example, the reflector 120 can be formed of a resin material provided with a reflecting layer formed of a metal such as aluminum on the inner face 121*a* of the main body 121. Moreover, the reflector 120 does not have to have a second attaching part 123. In this case, the actuator 180 can be attached to another constituent element other than the reflector 120, such as the substrate 191 or the heatsink 192 of the lighting device 100.

As shown in FIG. 3, the first lens 130, disposed in front of the lower portion of the reflector 120 and the substrate 191, is positioned apart from the reflector 120 and the substrate 191. The upper edge 130*a* of the first lens 130 is positioned higher than the upper face 191*a* of the substrate 191. The lower edge 130*b* of the first lens 130 is positioned lower than the lower face 191*b* of the substrate 191.

Figure 7:
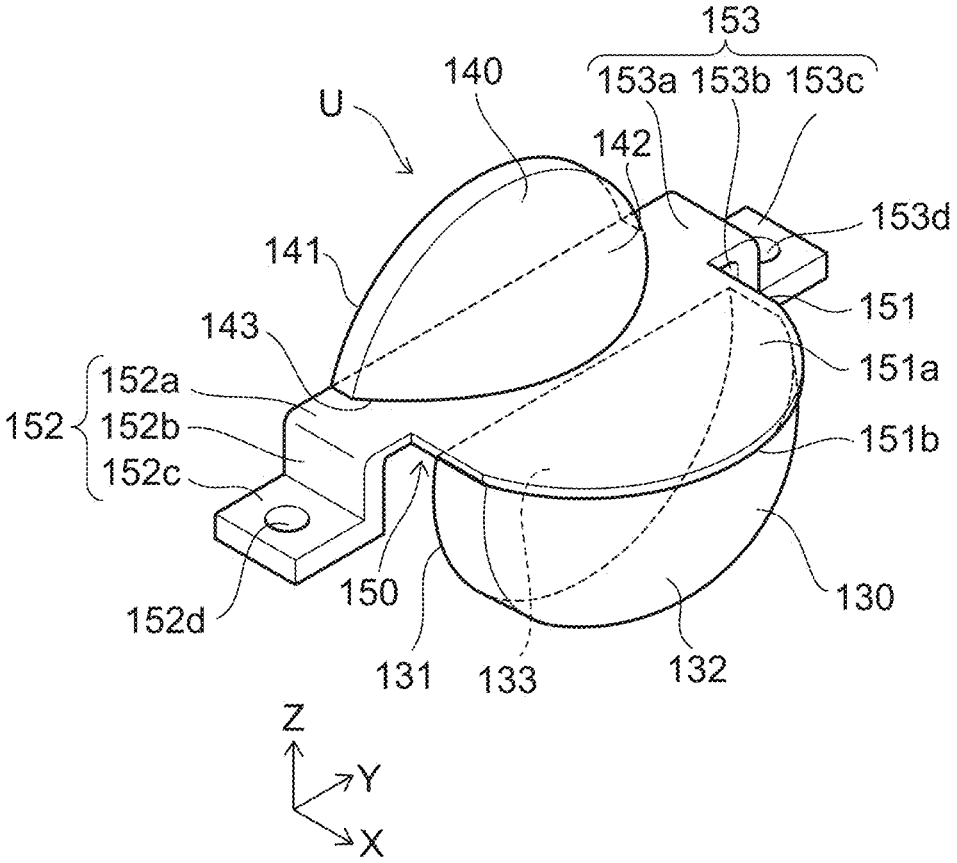
FIG. 7 is a perspective view of a first lens, a second lens, and a first light shielding member of the lighting device.

FIG. 7 is a perspective view of a first lens, a second lens, and a first light shielding member of the lighting device.

The first lens 130 is, for example, a collimating lens. The first lens 130 is formed of a light transmissive material, such as acrylic, polycarbonate, or the like. The shape of the first lens 130 is convex projecting towards the front. The surfaces of the first lens 130 include a first incident face 131, a first emission face 132, and an upper face 133.

The first incident face 131 is a flat face parallel to the up-down direction Z and the left-right direction Y. The first emission face 132 is located opposite the first incident face 131. The first emission face 132 is curved in a convex shape projecting towards the front. The upper face 133 is located between the upper edge of the first incident face 131 and the upper edge of the first emission face 132. The upper face 133 is a flat face parallel to the upper face 191*a* of the substrate 191.

As shown in FIG. 3, the second lens 140 is positioned higher than the first lens 130 in the up-down direction Z. In other words, the second lens 140 is disposed higher than the first lens 130 in the direction from the lower face 191*b* toward the upper face 191*a* of the substrate 191. The second lens 140, disposed in front of the upper portion of the reflector 120, is positioned apart from the reflector 120. The upper edge 140*a* of the second lens 140 is positioned higher than the inner face 121*a* of the main body 121 of the reflector 120. The lower edge 140*b* of the second lens 140 is positioned higher than the upper face of the light emission part 110.

As shown in FIG. 7, the second lens 140 is, for example, a collimating lens. The second lens 140 has a convex shape projecting towards the front. The second lens 140 is formed of a light transmissive material, such as acrylic, polycarbonate, or the like. The surfaces of the second lens 140 include a second incident face 141, a second emission face 142, and a lower face 143.

The second incident face 141 is a flat face parallel to the up-down direction Z and the left-right direction Y. The second emission face 142 is located opposite to the second incident face 141. The second emission face 142 is curved in a convex shape projecting towards the front. The lower face 143 is located between the lower edge of the second incident face 141 and the lower edge of the second emission face 142. The lower face 143 is a flat face parallel to the upper face 191*a* of the substrate 191.

As shown in FIG. 3, the distance E2 between the light emission part 110 and the second incident face 141 in the front-back direction X is smaller than the distance E1 between the light emission part 110 and the first incident face 131 in the front-back direction X. The distance from the center of the light emission part 110 to the second incident face 141 is smaller than the distance from the center of the light emission part 110 to the first incident face 131.

The area of the first incident face 131 in this embodiment is larger than the area of the second incident face 141. The magnitude relation between the area of the first incident face 131 and the area of the second incident face 141 is not limited to this. The dimension (thickness) of the second lens 140 in the front-back direction X, in this embodiment, is smaller than the dimension (thickness) of the first lens 130 in the front-back direction X, but the magnitude relation between the thicknesses of the first lens 130 and the second lens 140 is not limited to this.

A first light shielding member 150 is disposed between the first lens 130 and the second lens 140. The first light shielding member 150 in this embodiment has light absorbing properties. In the description herein, "light absorption" means light reflectivity of less than 1% for the irradiated light. The first light shielding member 150 is preferably dark colored, more preferably black. The first light shielding member 150 can be formed of, for example, a resin material with a black coating applied to the surface. Alternatively, the first light shielding member 150 can be formed of a light-absorbing material such as carbon black. However, the first light shielding member 150 can have light reflectivity.

As shown in FIG. 7, the first light shielding member 150 in this embodiment has a main body 151 positioned between the first lens 130 and the second lens 140, and a first attaching part 152 and a second attaching part 153 to be attached to the heatsink 192.

The main body 151 has a plate-like shape. The surfaces of the main body 151 include an upper face 151*a* and a lower face 151*b*. The upper face 151*a* is parallel to the upper face 191*a* of the substrate 191. The upper face 151*a* is in contact with the lower face 143 of the second lens 140. The lower face 151*b* is located opposite the upper face 151*a*. The lower face 151*b* is in contact with the upper face 133 of the first lens 130. The main body 151 covers the entire upper face 133 of the first lens 130 and the entire lower face 143 of the second lens 140.

The first attaching part 152 includes a first extended portion 152*a* that is connected to the main body 151 and extending to the right, a second extended portion 152*b* that is connected to the first extended portion 152*a* and extending downwards, and a third extended portion 152*c* that is connected to the second extended portion 152*b* and extending to the right. The third extended portion 152*c* is provided with a through hole 152*d* passing through the third extended portion 152*c* in the up-down direction Z. As shown in FIG. 2, in the through hole 152*d* and a hole 192*a* of the heatsink 192, a fastener such as a screw or rivet for fastening the first light shielding member 150 to the heatsink 192 will be provided.

As shown in FIG. 7, the second attaching part 153 has a first extended portion 153*a* that is connected to the main body 151 and extends to the left, a second extended portion 153*b* that is connected to the first extended portion 153*a* and extends downwards, and a third extended portion 153*c* that is connected to the second extended portion 153*b* and extends to the left. The third extended portion 153*c* is provided with a through hole 153*d* passing through the third extended portion 153*c* in the up-down direction Z. As shown in FIG. 2, in the through hole 153*d* and a hole 192*a* of the heatsink 192, a fastener such as a screw or rivet for fastening the first light shielding member 150 to the heatsink 192 will be provided.

The construction of the first light shielding member 150 is not limited to what has been described above. For example, the first light shielding member 150 does not have to be in contact with the upper face 133 of the first lens 130 and the lower face 143 of the second lens 140. Furthermore, the first light shielding member 150 does not have to be attached to the heatsink 192.

The first lens 130, the second lens 140, and the first light shielding member 150 will be collectively referred to as a "lens unit U" below.

Figure 8A:
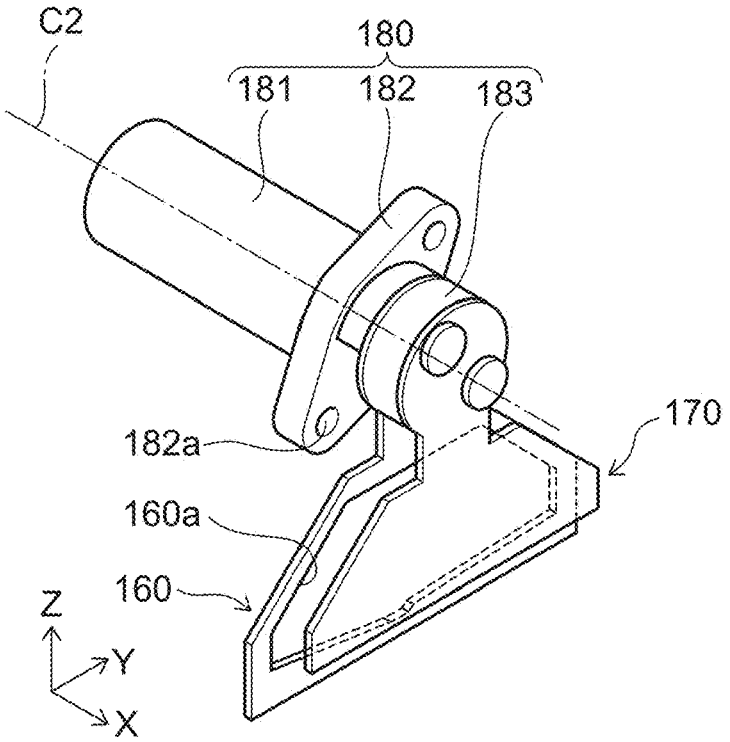
FIG. 8A is a perspective view of a second light shielding member, a third light shielding member, and an actuator of the lighting device.

FIG. 8A is a perspective view of a second light shielding member, a third light shielding member, and an actuator of the lighting device.

Figure 8B:
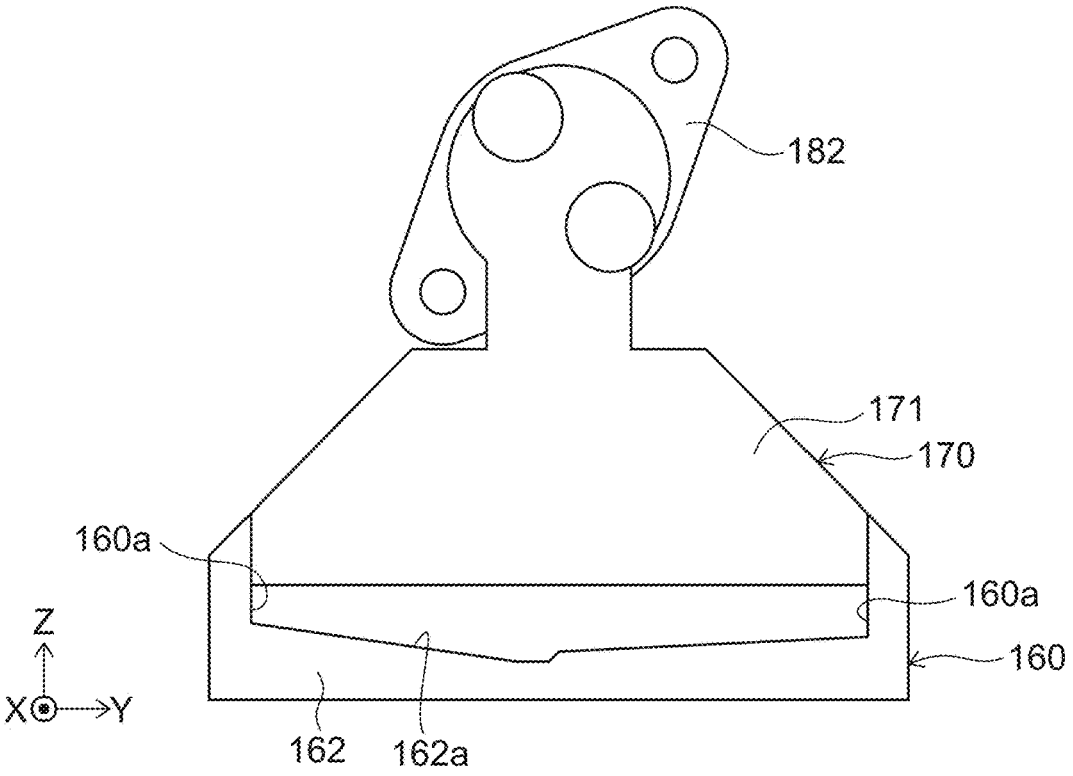
FIG. 8B is a plan view of the second light shielding member, the third light shielding member, and the actuator when viewed in the direction from the front to the back.

FIG. 8B is a plan view of the second light shielding member, the third light shielding member, and the actuator when viewed in the direction from the front to the back.

Figure 9A:
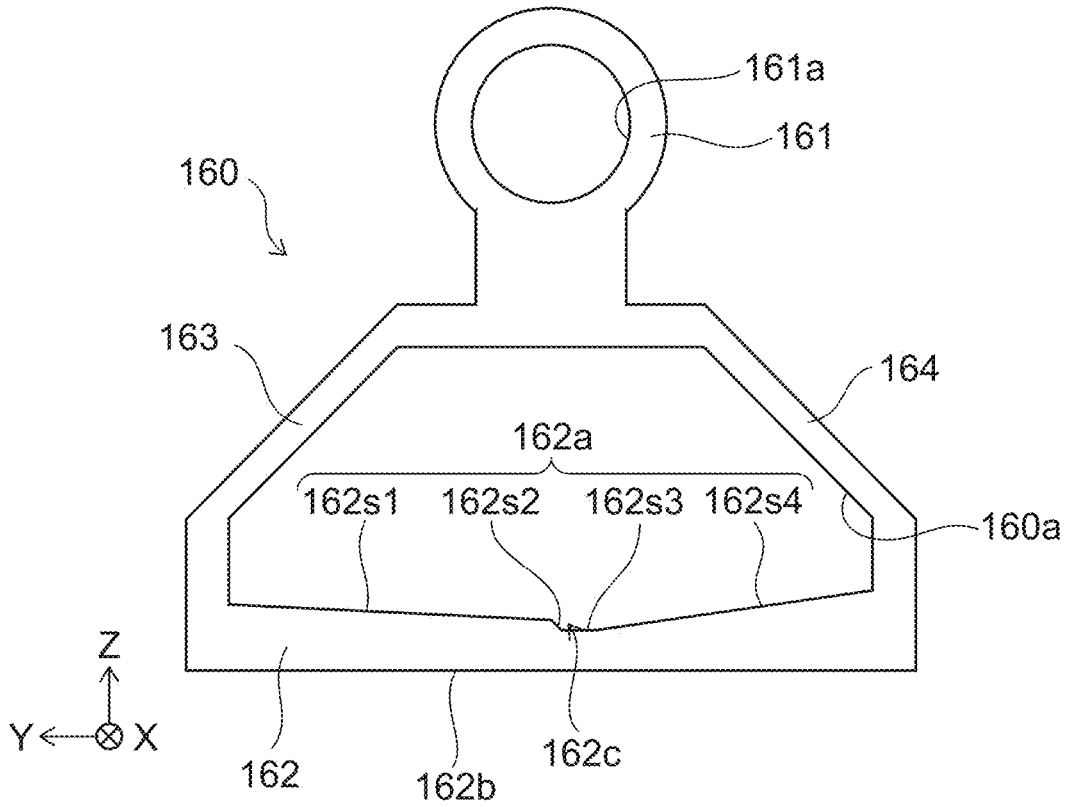
FIG. 9A is a plan view of the second light shielding member when viewed in the direction from the back to the front.

FIG. 9A is a plan view of the second light shielding member when viewed in the direction from the back to the front.

Figure 9B:
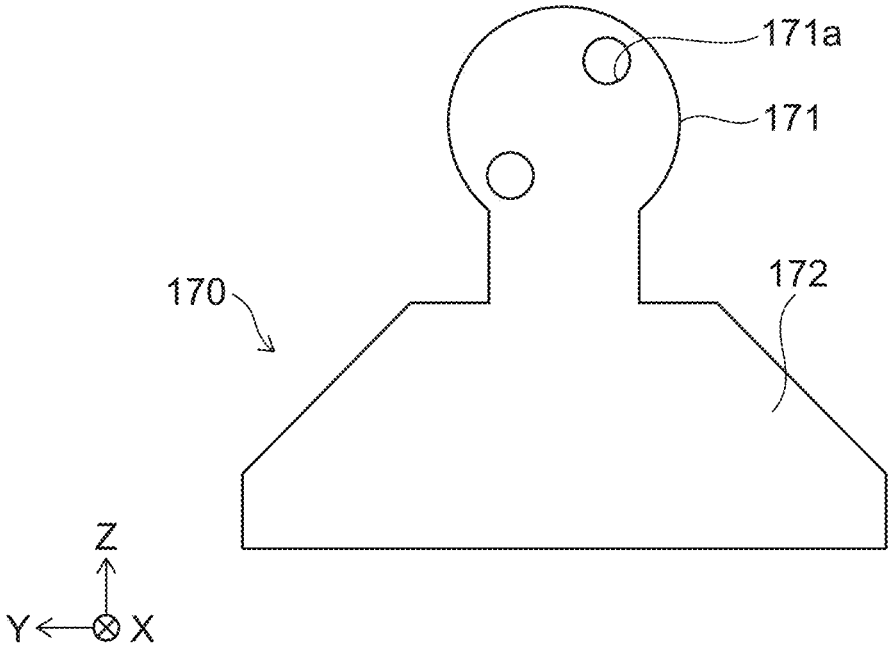
FIG. 9B is a plan view of the third light shielding member when viewed in the direction from the back to the front.

FIG. 9B is a plan view of the third light shielding member when viewed in the direction from the back to the front.

The second light shielding member 160 is joined to the shaft 183 of the actuator 180. The second light shielding member 160 in this embodiment has light absorbing properties. The second light shielding member 160 is preferably dark colored, more preferably black. The second light shielding member 160 can be formed of a resin material with a black coating applied to the surface. Alternatively, the second light shielding member 160 can be formed of a light-absorbing material, such as carbon black and the like. The second light shielding member 160 can have light reflectivity.

The second light shielding member 160 substantially has a plate-like shape and a through hole 160*a* passing through the second light shielding member 160 in the front-back direction X. As shown in FIG. 3, the second light shielding member 160 positioned between the reflector 120 and the lens unit U in the light-shielded state shields a portion of the light La advancing from the reflector 120 towards the first incident face 131 of the first lens 130 while allowing another portion of the light La to pass through the through hole 160*a*.

As shown in FIG. 9A, the second light shielding member 160 in this embodiment includes a joining part 161 joined to the shaft 183 of the actuator 180, a cut-off line forming part 162 positioned under the joining part 161 in the light-shielded state, a first connecting part 163 connecting the joining part 161 and the left edge of the cut-off line forming part 162, and a second connecting part 164 connecting the joining part 161 and the right edge of the cut-off line forming part 162. The through hole 160*a* is formed by the joining part 161, the cut-off line forming part 162, the first connecting part 163, and the second connecting part 164.

The joining part 161 is provided with a through hole 161*a* passing through the joining part 161 in the front-back direction X. As shown in FIG. 3, the shaft 183 of the actuator 180 is placed through the through hole 161*a*.

The cut-off line forming part 162 in the light-shielded state shields a portion of the light La advancing from the reflector 120 towards the first incident face 131 of the first lens 130, thereby forming a cut-off line J (see FIG. 13A) in a low beam light distribution pattern.

The "cut-off line J" means the upper light-dark boundary in the low beam light distribution pattern. The low beam light distribution pattern is desired to reduce irradiation of light against oncoming traffic so as not to dazzle oncoming drivers, while irradiating signs or pedestrians on the sidewalk to allow the driver to see the signs and the pedestrians on the sidewalk. Accordingly, in the case where left-hand traffic is practiced such as in Japan, formation of a cut-off line that rises to the left is desired. An example of the shape of a cut-off line forming part 162 corresponding to left-hand traffic will be explained below.

As shown in FIG. 9A, the cut-off line forming part 162 extends in the left-right direction Y in the light-shielded state. In the light-shielded state, the surfaces of the cut-off line forming part 162 include an upper face 162*a* and a lower face 162*b* located opposite the upper face 162*a*.

The lower face 162*b* is parallel to the left-right direction Y in the light-shielded state. The upper face 162*a* includes a first region 162*s*1, a second region 162*s*2, a third region 162*s*3, and a fourth region 162*s*4. The first region 162*s*1 is in contact with the first connecting part 163 and oblique to the left-right direction Y so as to go down towards the right. The second region 162*s*2 is in contact with the right edge of the first region 162*s*1. The second region 162*s*2 is oblique to the left-right direction Y so as to go down towards the right. The third region 162*s*3 is in contact with the right edge of the second region 162*s*2. The third region 162*s*3 is parallel to the left-right direction Y. The fourth region 162*s*4 is in contact with the right edge of the third region 162*s*3. The fourth region 162*s*4 is oblique to the left-right direction Y so as to go up towards the right. Accordingly, the upper face 162*a* is provided with a stepped portion 162*c* formed by the regions 162*s*1, 162*s*2, 162*s*3, and 162*s*4. In the case of right-hand traffic, formation of a cut-off line that rises to the right is required. Accordingly, the shape of the cut-off line forming part for right-hand traffic would be the horizontally reversed shape of the cut-off line forming part 162 for left-hand traffic.

A portion of the first connecting part 163 extends obliquely to the up-down direction Z so as to extend downwards towards the left in the light-shielded state. A portion of the second connecting part 164 extends obliquely to the up-down direction Z so as to extend downwards towards the right in the light-shielded state.

As shown in FIG. 3, the position of the second light shielding member 160 in the direction from the light emission part 110 to the first lens 130 is between the position of the light emission part 110 and the position of the first lens 130. The position of the third light shielding member 170 in the direction from the light emission part 110 to the second lens 140 is between the position of the light emission part 110 and the position of the second lens 140. As shown in FIG. 8A, the third light shielding member 170 is disposed in front of the second light shielding member 160. The third light shielding member 170 is positioned apart from the second light shielding member 160. In other words, as shown in FIG. 3, the distance E3 between the light emission part 110 and the second light shielding member 160 in the front-back direction X is smaller than the distance E4 between the light emission part 110 and the third light shielding member 170 in the front-back direction X. However, the position of the third light shielding member 170 in the front-back direction X can be made the same as the position of the second light shielding member 160 by integrating the third light shielding member 170 and the second light shielding member 160, or adjusting the positional relationship between the lens unit U and the third and second light shielding members 170 and 160.

The third light shielding member 170 in this embodiment has light absorbing properties. The third light shielding member 170 is preferably dark colored, more preferably black. The third light shielding member 170 can be formed of a resin material with a black coating applied to the surface, for example. Alternatively, the third light shielding member 170 can be formed of a light-absorbing material, such as carbon black and the like. The third light shielding member 170 can have light reflectivity.

FIG. 9B is a plan view of the third light shielding member 170 when viewed in the direction from the back to the front.

The third light shielding member 170 has a plate-like shape. The third light shielding member 170 has a joining part 171 and a main body 172. The joining part 171 is joined to the shaft 183 of the actuator 180. The main body 172 is connected to the joining part 171 and covers the entire second incident face 141.

The joining part 171 is provided with through holes 171*a* passing through the joining part 171 in the front-back direction. In the through holes 171*a*, fasteners such as screws or rivets will be provided to fasten the third light shielding member 170 to the shaft 183 of the actuator 180.

As shown in FIG. 3, the main body 172 in the light-shielded state covers the entire second incident face 141 and shields the second portion L2 of the light emitted from the light emission part 110 advancing towards the second incident face 141. In the light-shielded state, the lower edge of the main body 172 is positioned higher than the upper face 133 of the first lens 130. The lower edge of the main body 172 is positioned above the upper face 162*a* of the cut-off line forming part 162 of the second light shielding member 160.

The actuator 180, as shown in FIG. 8A, includes a motor 181, a holder 182 that holds the motor 181, and a shaft 183 that is interlocked with the motor 181. The holder 182 is provided with through holes 182*a* passing through the holder 182 in the front-back direction X. The shaft 183 is located in front of the motor 181, and extends in the front-back direction X. When the motor 181 is rotated, the shaft 183 rotates about the axis C2 which extends in the front-back direction X. The rotation of the shaft 183 causes the second light shielding member 160 and the third light shielding member 170 to rotate about the axis C2.

As shown in FIG. 1, by actuating the motor 181 to thereby rotate the shaft 183, the actuator 180 switches between the following states (i) and (ii):

(i) the light-shielded state, in which the second light shielding member 160 is positioned to shield a portion of the light L1*a* advancing from the reflector 120 to the first incident face 131, and the third light shielding member 170 is positioned to shield the light L2 advancing from the light emission part 110 to the second incident face 141, and (ii) the non-light-shielded state, in which the second light shielding member 160 is positioned not to shield the light L1*a* advancing from the reflector 120 towards the first incident face 131, and the third light shielding member 170 is positioned not to shield the light L2 advancing from the light emission part 110 towards the second incident face 141.

The light emission part 110 and the actuator 180 are electrically connected to a controller 193. The controller 193, which is electrically connected to an integrated controller installed in a vehicle, controls the light emission part 110 and the actuator 180 in accordance with the control signals received from the integrated controller.

The controller 193 includes, for example, a control circuit for the light emission part 110, a control circuit for the actuator 180, a central processing unit (CPU), and an electronic control unit (ECU) including a memory. The controller 193 controls the light emitting element 111 in the light emission part 110 to turn on or off the light emitting element 111. The controller 193 controls the motor 181 of the actuator 180 to switch between the light-shielded state and the non-light-shielded state.

The operation of a lighting device 100 according to the embodiment will be explained next.

Figure 10:
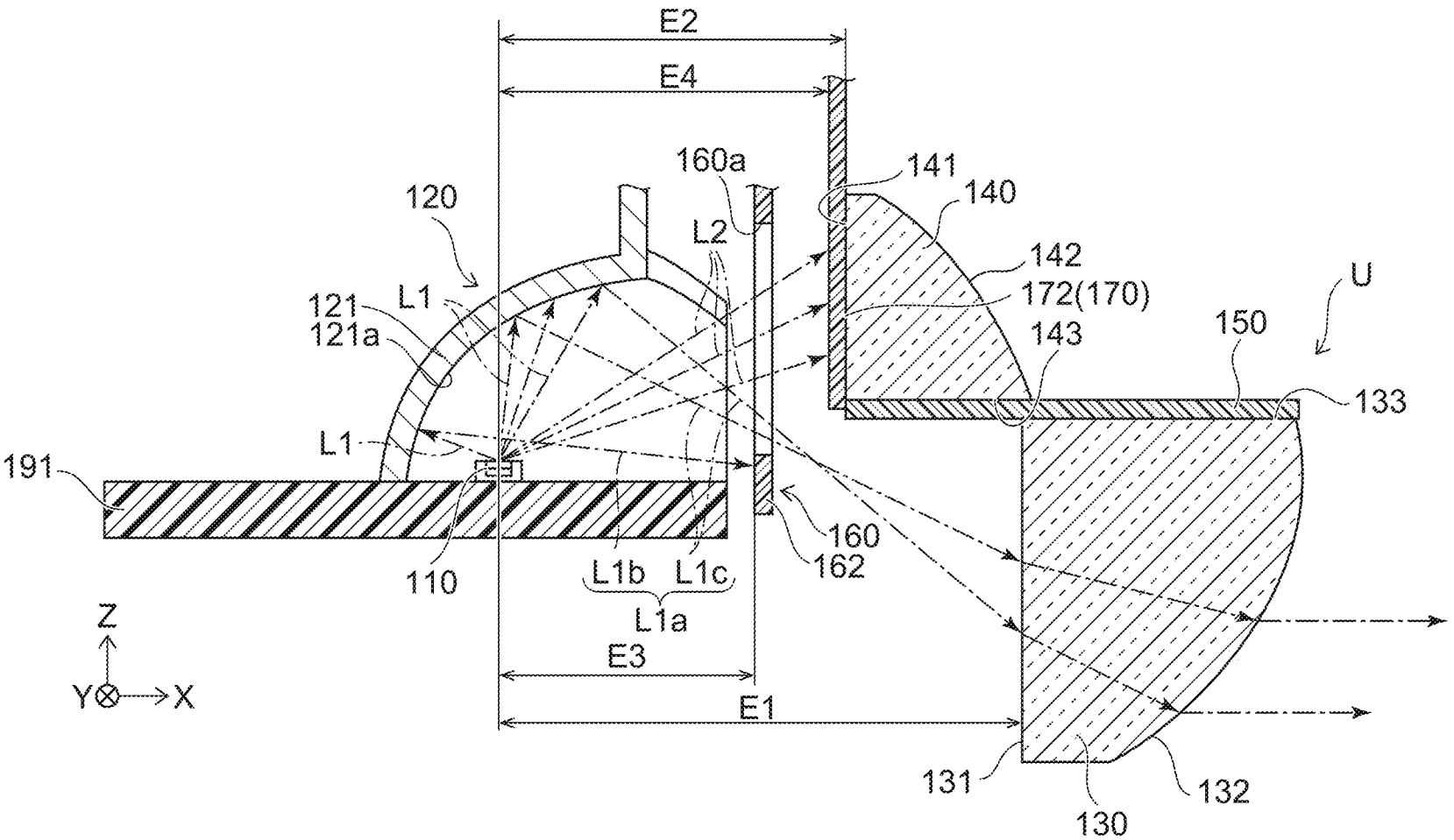
FIG. 10 is a diagram showing the paths of the light emitted from the light emission part in the light-shielded state.

FIG. 10 is a diagram showing the paths of the light emitted from the light emission part in the light-shielded state.

Figure 11:
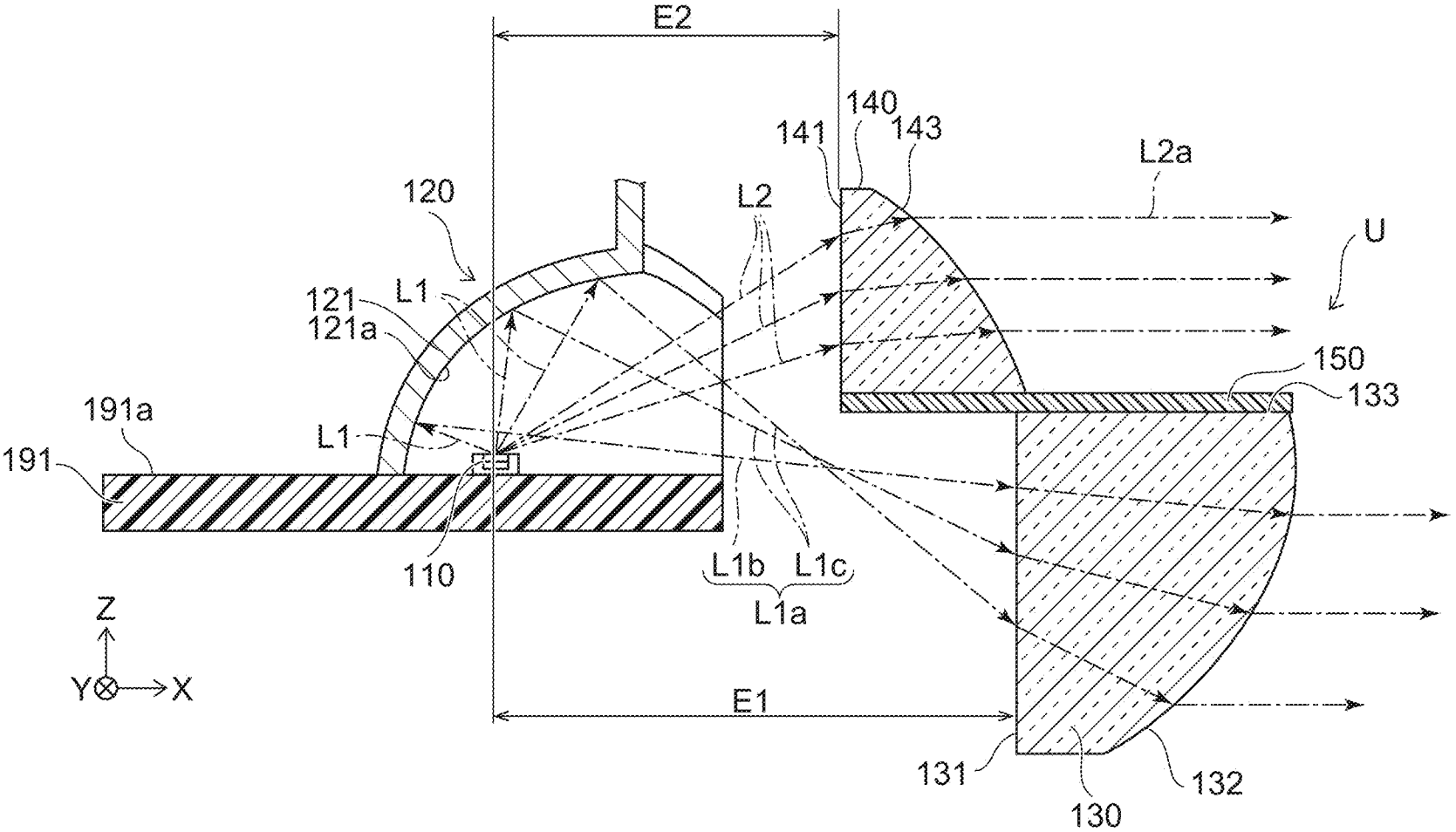
FIG. 11 is a diagram showing the paths of the light emitted from the light emission part in the non-light-shielded state.

FIG. 11 is a diagram showing the paths of the light emitted from the light emission part in the non-light-shielded state.

Figure 12A:
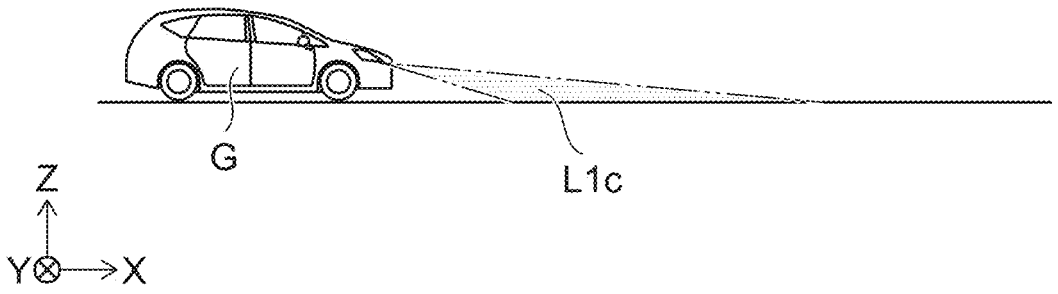
FIG. 12A is a diagram illustrating the light output by a vehicle in the light-shielded state.

FIG. 12A is a diagram illustrating the light output by a vehicle in the light-shielded state.

Figure 12B:
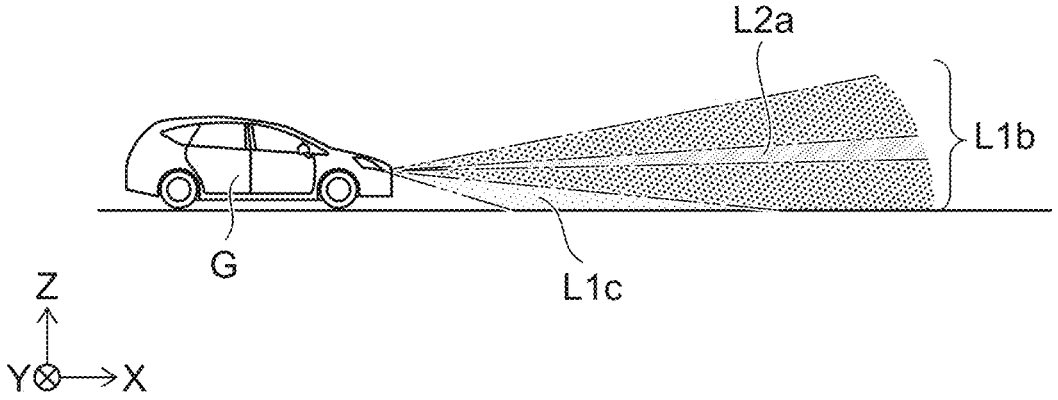
FIG. 12B is a diagram illustrating the light output by a vehicle in the non-light-shielded state.

FIG. 12B is a diagram illustrating the light output by a vehicle in the non-light-shielded state.

Figure 13A:
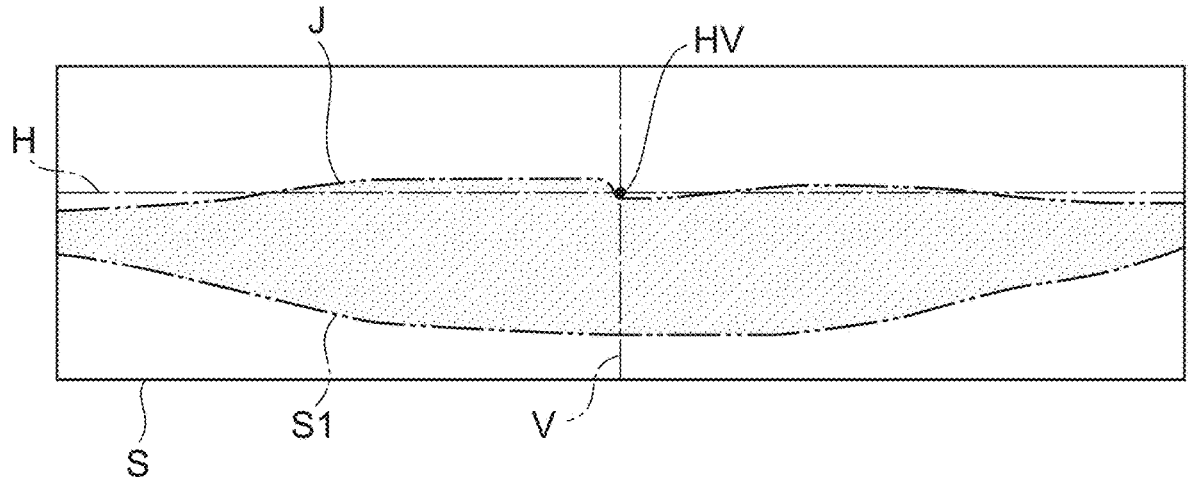
FIG. 13A is a diagram illustrating a light distribution pattern on a screen placed in front of a vehicle in the light-shielded state.

FIG. 13A is a diagram illustrating a light distribution pattern on a screen placed in front of a vehicle in the light-shielded state.

Figure 13B:
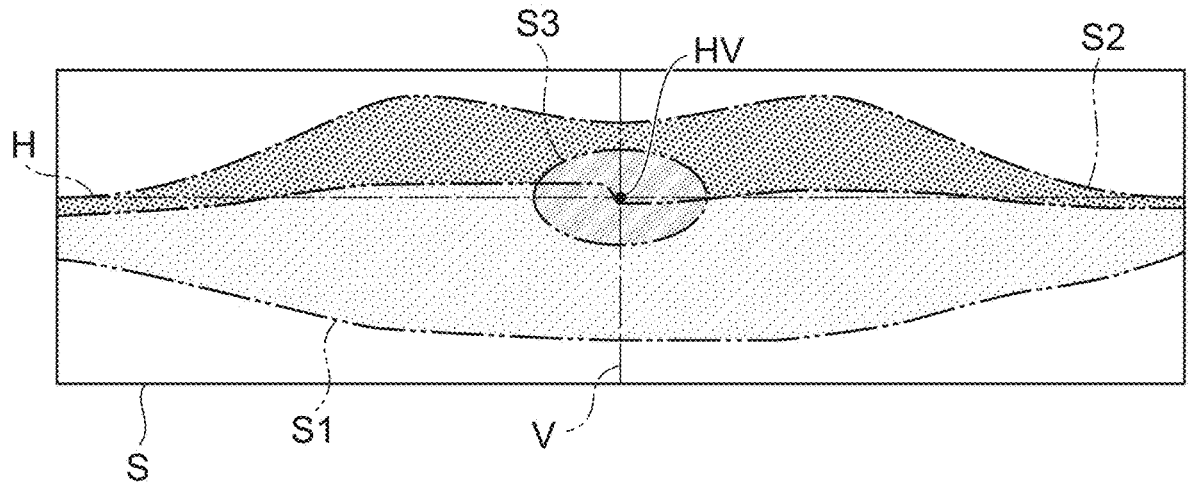
FIG. 13B is a diagram illustrating a light distribution pattern on a screen placed in front of a vehicle in the non-light-shielded state.

FIG. 13B is a diagram illustrating a light distribution pattern on a screen placed in front of a vehicle in the non-light-shielded state.

In FIG. 13A and FIG. 13B, the HV point, the H line, and the V line on the screen S specified in the regulations such as the Headlight Test (Regulation No. 112 of the UN/ECE) for left-hand traffic enforced in countries such as Japan are denoted as HV, H, and V, respectively. In FIG. 12A to FIG. 13B, moreover, the light irradiated regions are indicated by using dot patterns. In FIG. 12A to FIG. 13B, dot patterns are varied to facilitate distinctions among the regions explained below. Accordingly, a dot pattern difference does not represent a luminous intensity difference.

When a control signal for outputting a low beam light distribution pattern is received from the integrated controller, as shown in FIG. 10, the controller 193 controls the actuator 180 to achieve the light-shielded state while turning on the light emission part 110.

This lights up the light emission part 110 in the state in which the second light shielding member 160 and the third light shielding member 170 are positioned between the reflector 120 and the lens unit U. At this point, the first portion L1 of the light emitted from the light emission part 110 is reflected by the reflector 120. The light L1*a*, the vast majority of the first portion L1 reflected by the reflector 120, advances towards the first incident face 131.

The cut-off line forming part 162 is positioned between the lower portion of the reflector 120 and the first incident face 131 of the first lens 130. Accordingly, a portion L1*b* of the light L1*a* advancing from the reflector 120 to the first incident face 131 is shielded by the cut-off line forming part 162.

The through hole 160*a* is positioned above the cut-off line forming part 162 and in front of the reflector 120. Accordingly, a portion L1*c*, another portion of the light L1*a* advancing from the reflector 120 towards the first incident face 131, enters the first incident face 131 and exits the first emission face 132. At this point, the first light shielding member 150 is provided between the first lens 130 and the second lens 140 in the up-down direction Z. Accordingly, the light having entered the first lens 130 is less likely to enter the second lens 140. Also, direct light from the light emission part 110 is less likely to enter the second lens 140 through the lower face 143 of the second lens 140. This can reduce stray light in the light-shielded state.

The light L1*c* that has exited from the first emission face 132, as shown in FIG. 12A, illuminates the region in front of the vehicle G having the lighting device 100 installed therein. As shown in FIG. 13A, the light L1*c* that has exited the first emission face 132 primarily illuminates the first region S1 positioned below the H line on the screen S. Because the portion L1*b* of the light L1*a* is shielded by the cut-ff line forming part 162, a cut-off line J is formed on the upper end of the first region S1. The cut-off line J can hinder illuminating the region in the vicinity of the HV point and the region on the right side of the V line above the H line. In other words, irradiation of light against oncoming traffic can be hindered.

As shown in FIG. 10, the second portion L2 of the light emitted from the light emission part 110 advances towards the second incident face 141 of the second lens 140 without being reflected by the reflector 120. In the light-shielded state, the third light shielding member 170 covers the entire second incident face 141. Accordingly, the second part L2 is shielded by the third light shielding member 170 and substantially does not enter the second incident face 141.

The distance E3 between the light emission part 110 and the second light shielding member 160 in the front-back direction X is smaller than the distance E4 between the light emission part 110 and the third light shielding member 170 in the front-back direction X. Accordingly, the light L1*a* advancing from the reflector 120 to the first incident face 131 of the first lens 130 is less likely to be shielded by the third light shielding member 170.

In this manner, in the light-shielded state, a light distribution pattern formed primarily by the light Lc that has exited form the first emission face 132 of the first lens 130 can be achieved.

When a control signal for outputting a high beam light distribution pattern is received from the integrated controller, as shown in FIG. 11, the controller 193 controls the actuator 180 to achieve the non-light-shielded state while turning on the light emission part 110. This lights up the light emission part 110 in the state in which the second light shielding member 160 and the third light shielding member 170 are both entirely out of the positions between the reflector 120 and the lens unit U.

The first portion L1 of the light emitted from the light emission part 110 is reflected by the reflector 120. The light L1*a*, the vast majority of the first portion L1 reflected by the reflector 120, advances towards the first incident face 131.

In the non-light-shielded state, as shown in FIG. 11, the cut-off line forming part 162 of the second light shielding member 160 is not positioned between the reflector 120 and the lens unit U. Accordingly, the portion L1*b* of the light L1*a* that would be shielded in the light-shielded state enters the first incident face 131 and exits from the first emission face 132.

Similar to the light-shielded state, the portion L1*c*, another portion of the light L1*a* advancing from the reflector 120 towards the first incident face 131 enters the first incident face 131 and exits from the first emission face 132.

The light L1*c* that has exited from the first emission face 132, as shown in FIG. 12B, illuminates the region in front of the vehicle G. As a result, as shown in FIG. 13B, the light L1*c* primarily illuminates the first region S1 on the screen S located under the H line. The light L1*b* that has exited from the first emission face 132, as shown in FIG. 12B, illuminates the region in front of the vehicle G and above the region illuminated by the light L1*c*. As a result, as shown in FIG. 13B, the light L1*b* primarily illuminates the second region S2 on the screen S that is positioned above the first region S1 and includes the HV point while spreading in the direction in which the H line extends. This allows the light to illuminate the region above the H line on the screen S as well as increasing the luminous intensity of the vicinity of the HV point.

As shown in FIG. 11, in the non-light-shielded state, the entire second incident face 141 is exposed from the third light shielding member 170. Accordingly, the second portion L2 of the light emitted from the light emission part 110 enters the second incident face 141. The distance E2 between the light emission part 110 and the second incident face 141 of the second lens 140 in the front-back direction X is smaller than the distance E1 between the light emission part 110 and the first incident face 131 of the first lens 130 in the front-back direction. Accordingly, the light emitted from the light emission part 110 advancing upwards and forward can readily enter the second incident face 141 of the second lens 140. This, as a result, can increase the light extraction efficiency of the second lens 140.

The light L2*a*, the vast majority of the light L2 that has entered the second incident face 141 exits from the second emission face 142. The light L2*a* that has exited from the second emission face 142, as shown in FIG. 12B, primarily illuminates the region in front of the vehicle G and above the region illuminated by the light L1*c*. As a result, as shown in FIG. 13B, the light L2*a* primarily illuminates the third region S3 on the screen S that includes the HV point and the vicinity. The lower portion of the third region S3 overlaps a portion of the first region S1, and the upper portion of the third region S3 overlaps a portion of the second region S2. The upper portion of the third region S3 overlapping a portion of the second region S2 in the vicinity of the HV point can increase the luminous intensity in the vicinity of the HV point.

Moreover, as shown in FIG. 11, furthermore, the first light shielding member 150 is provided between the first lens 130 and the second lens 140 in the up-down direction Z. Accordingly, the light L1*b* and L1*c* that has entered the first lens 130 is less likely to enter the second lens 140. Also, the light L2 that has entered the second lens 140 is less likely to enter the first lens 130. This can reduce stray light in the non-light-shielded state.

As a result, in the non-light-shielded state, as shown in FIG. 13B, a light distribution pattern formed by the light existing from the first emission face 132 of the first lens 130 and the light existing from the second emission face 142 of the second lens 140 can be achieved.

In the light distribution pattern in the light-shielded state, irradiation of light to the HV point is hindered and the region primarily under the H line is illuminated, whereas in the light distribution pattern in the non-light-shielded state, the vicinity of the HV point and the region above the H line are also illuminated. Accordingly, the light distribution pattern in the light-shielded state can be used as the low beam light distribution pattern, and the light distribution pattern in the non-light-shielded state can be used as the high beam light distribution pattern.

The effect of the embodiment will be explained next.

The lighting device 100 according to this embodiment includes a light emission part 110, a reflector 120, a first lens 130, a second lens 140, a first light shielding member 150, a second light shielding member 160, a third light shielding member 170, and an actuator 180.

The reflector 120 is disposed above the light emission part 110, and reflects a first portion L1 of the light emitted from the light emission part 110.

The first lens 130 has a first incident face 131 from which the light L1*a* reflected by the reflector 120 enters.

The second lens 140 is disposed higher than the first lens 130 in the up-down direction Z. The second lens 140 has a second incident face 141 from which a second portion L2 of the light emitted from the light emission part 110 enters. The distance E2 between the light emission part 110 and the second incident face 141 in the horizontal direction is smaller than the distance E1 between the emission face 110 and the first incident face 131 in the horizontal direction.

The first light shielding member 150 is disposed between the first lens 130 and the second lens 140 in the up-down direction Z.

The position of the second light shielding member 160 in the front-back direction X is between the position of the light emission part 110 and the position of the first lens 130.

The position of the third light shielding member 170 in the front-back direction X is between the position of the light emission part 110 and the position of the second lens 140.

The actuator 180 can switch between the light-shielded state and the non-light-shielded state by moving the second light shielding member 160 and the third light shielding member 170.

In the light-shielded state, the second light shielding member 160 shields a portion of the light L1*a* advancing from the reflector 120 to the first incident face 131, and the third light shielding member 170 shields the second portion L2 of the light advancing from the light emission part 110 to the second incident face 141.

In the non-light-shielded state, the second light shielding member 160 does not shield the light L1*a* advancing from the reflector 120 towards the first incident face 131, and the third light shielding member 170 does not shield the second portion L2.

According to the lighting device 100 described above, switching between the low beam light distribution pattern and the high beam light distribution pattern can be achieved by using a single light emission part 110.

In the lighting device 100 described above, moreover, the distance E2 between the light emission part 110 and the second incident face 141 of the second lens 140 in the front-back direction X is smaller than the distance E1 between the light emission part 110 and the first incident face 131 of the first lens 130 in the front-back direction. Accordingly, the light emitted by the light emission part 110 upwards and forward can readily enter the second incident face 141 of the second lens 140. This, as a result, can increase the light extraction efficiency of the second lens 140. This can increase the luminous intensity at the HV point and the vicinity thereof in the high beam light distribution pattern.

Furthermore, the first light shielding member 150 is provided between the first lens 130 and the second lens 140 in the up-down direction Z. Accordingly, in the light-shielded state, the light L1*b* that has entered the first lens 130 is less likely to enter the second lens 140, and direct light from the light emission part 110 is less likely to enter the second lens 140 from the lower face 143 of the second lens 140. Furthermore, in the non-light-shielded state, the light L1*b* and L1*c* that has entered the first lens 130 is less likely to enter the second lens 140, and the light L2*a* that has entered the second lens 140 is less likely to enter the first lens 130. This can reduce stray light in both the light-shielded state and the non-light-shielded state.

In the light-shielded state, the distance E3 between the light emission part 110 and the second light shielding member 160 in the horizontal direction is smaller than the distance E4 between the light emission part 110 and the third light shielding member 170 in the horizontal direction. Accordingly, the third light shielding member 170 is less likely to shield the light L1*a* advancing from the reflector 120 towards the first incident face 131 of the first lens 130.

The first lens 130 has a first emission face 132 located opposite the first incident face 131, and an upper face 133 located between the upper edge of the first incident face 131 and the upper edge of the first emission face 132. The second lens 140 has a second emission face 142 located opposite the second incident face 141, and a lower face 143 located between the lower edge of the second incident face 141 and the lower edge of the second emission face 142. The first light shielding member 150 covers the upper face 133 and the lower face 143. Accordingly, the light that has entered the first lens 130 is less likely to enter the second lens 140, and the light that has entered the second lens 140 is less likely to enter the first lens 130.

Moreover, the area of the first incident face 131 is larger than the area of the second incident face 141. Accordingly, the first lens 130 can readily take in the light advancing from the reflector 120.

The actuator 180 can switch between the light-shielded state and the non-light-shielded state by rotating the second light shielding member 160 and the third light shielding member 170. This can achieve switch between the light-shielded state and the non-light-shielded state by a simple structure.

Furthermore, the first light shielding member 150 is a light absorbing material. It can thus reduce stray light.

In the embodiment described above, an example in which the actuator rotates the second light shielding member and the third light shielding member has been explained. However, the actuator can be designed to switch between the light-shielded state and the non-light-shielded state by moving the second and third light shielding members in the up-down direction or the left-right direction.

In the embodiment described above, moreover, an example in which the actuator rotates the second and third light shielding members in the same direction has been explained. However, the directions of rotation for the second and third light shielding members can be different from one another.

What is claimed is:

1. A lighting device comprising:

a light emission part;

a reflector disposed above the light emission part and configured to reflect a first portion of light emitted from the light emission part;

a first lens having a first incident face through which light reflected by the reflector enters;

a second lens disposed higher than the first lens in an up-down direction, and having a second incident face through which a second portion of the light emitted from the light emission part enters, wherein a distance between the light emission part and the second incident face in a horizontal direction is smaller than a distance between the light emission part and the first incident face in the horizontal direction;

a first light shielding member disposed between the first lens and the second lens in the up-down direction;

a second light shielding member whose position in the horizontal direction is between the position of the light emission part and the position of the first lens;

a third light shielding member whose position in the horizontal direction is between the position of the light emission part and the position of the second lens; and an actuator configured to switch the lighting device between a light-shielded state and a non-light-shielded state by moving the second light shielding member and the third light shielding member, wherein, when the lighting device is in the light-shielded state, the second light shielding member shields a portion of light advancing from the reflector towards the first incident face, and the third light shielding member shields the second portion of the light advancing from the light emission part towards the second incident face, wherein, when the lighting device is in the non-light-shielded state, the second light shielding member does not shield the light advancing from the reflector towards the first incident face, and the third light shielding member does not shield the second portion of the light.

2. The lighting device according to claim 1, wherein, when the lighting device is in the light-shielded state, the distance between the light emission part and the second light shielding member in the horizontal direction is smaller than the distance between the light emission part and the third light shielding member in the horizontal direction.

3. The lighting device according to claim 1, wherein:

the first lens has:

a first emission face located opposite to the first incident face; and an upper face located between an upper edge of the first incident face and an upper edge of the first emission face, the second lens has:

a second emission face located opposite to the second incident face; and a lower face located between a lower edge of the second incident face and a lower edge of the second emission face, wherein the first light shielding member covers the upper face of the first lens and the lower face of the second lens.

4. The lighting device according to claim 1, wherein an area of the first incident face is larger than an area of the second incident face.

5. The lighting device according to claim 1, wherein the actuator is configured to switch the lighting device between the light-shielded state and the non-light-shielded state by rotating the second light shielding member and the third light shielding member.

6. The lighting device according to claim 1, wherein the first light shielding member is a light absorbing member.

7. A headlight comprising:

a lighting device according to claim 1.

8. A lighting device comprising:

a substrate having an upper face and a lower face;

a light emission part disposed on the upper face of the substrate;

a reflector disposed on the upper face of the substrate to cover the light emission part, wherein the reflector is configured to reflect a first portion of light emitted from the light emission part;

a first lens having:

a first incident face through which the light reflected by the reflector enters, a first emission face from which the light that has entered the first incident face exits, and an upper face located between the first incident face and the first emission face;

a second lens having:

a second incident face through which a second portion of the light emitted from the light emission part enters;

a second emission face from which the light that has entered the second incident face exits; and a lower face located between the second incident face and the second emission face, wherein the second lens is disposed higher than the first lens in a direction from the lower face to the upper face of the substrate, and a distance from a center of the light emission part to the second incident face is smaller than a distance from the center of the light emission part to the first incident face;

a first light shielding member disposed between the upper face of the first lens and the lower face of the second lens;

a second light shielding member whose position in the direction from the light emission part to the first lens is between the position of the light emission part and the position of the first lens;

a third light shielding member whose position in the direction from the light emission part to the second lens is between the position of the light emission part and the position of the second lens; and an actuator configured to switch the lighting device between a light-shielded state and a non-light-shielded state by moving the second light shielding member and the third light shielding member, wherein, when the lighting device is in the light-shielded state, the second light shielding member shields a portion of light advancing from the reflector towards the first incident face, and the third light shielding member shields the second portion of the light advancing from the light emission part towards the second incident face, wherein, when the lighting device is in the non-light-shielded state, the second light shielding member does not shield the light advancing from the reflector towards the first incident face, and the third light shielding member does not shield the second portion of the light.

* * * * *